US011096851B2

(12) United States Patent
Souke et al.

(10) Patent No.: US 11,096,851 B2
(45) Date of Patent: Aug. 24, 2021

(54) AUTOMATED ADJUSTMENTS FOR PATIENT SUPPORT APPARATUS

(71) Applicant: Stryker Corporation, Kalamazoo, MI (US)

(72) Inventors: Chad Souke, Kalamazoo, MI (US); Martin Fecteau, Kalamazoo, MI (US); Brandon Naber, Kalamazoo, MI (US); Aaron Furman, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 42 days.

(21) Appl. No.: 16/549,598

(22) Filed: Aug. 23, 2019

(65) Prior Publication Data

US 2020/0060909 A1 Feb. 27, 2020

Related U.S. Application Data

(60) Provisional application No. 62/722,257, filed on Aug. 24, 2018.

(51) Int. Cl.
*A61G 7/018* (2006.01)
*A61G 1/013* (2006.01)
(Continued)

(52) U.S. Cl.
CPC ..... *A61G 7/018* (2013.01); *A61G 1/013* (2013.01); *A61G 7/0507* (2013.01); *A61G 7/103* (2013.01); *A61G 7/1021* (2013.01); *A61G 7/1026* (2013.01); *A61G 7/1065* (2013.01); *A61G 2203/12* (2013.01); *A61G 2203/44* (2013.01)

(58) Field of Classification Search
CPC ..... A61G 7/018; A61G 1/013; A61G 7/0507; A61G 7/1021; A61G 7/1026; A61G 7/103; A61G 7/1065; A61G 2203/12; A61G 2203/44; A61G 7/012; A61G 1/048; A61G 2203/30; A61G 1/0275; A61G 7/015; A61G 7/16; A61G 2203/36; A61G 2203/40; A61G 7/1036
See application file for complete search history.

(56) References Cited

U.S. PATENT DOCUMENTS 4,776,047 A * 10/1988 DiMatteo ..... A61G 5/006 5/81.1 C
4,837,872 A 6/1989 DiMatteo et al.
(Continued)

*Primary Examiner* — David R Hare
*Assistant Examiner* — Madison Emanski
(74) *Attorney, Agent, or Firm* — Christopher G. Darrow; Darrow Mustafa PC

(57) ABSTRACT

An automated system and methods are provided for coordinating a transfer of a patient between patient support apparatuses. The system includes first and second patient support apparatuses having a patient support surface supported by an adjustable frame. A controller is provided and is configured to communicate with at least one of the first and second patient support apparatuses. The controller includes programmable instructions to coordinate automated movements of at least one of the patient support apparatuses in order to couple the support apparatuses at a preferential transfer position, engage or monitor at least one safety feature, and provide an indication that it is safe to transfer the patient between the first and second patient support apparatuses.

20 Claims, 14 Drawing Sheets

(51) Int. Cl.
*A61G 7/10* (2006.01)
*A61G 7/05* (2006.01)

(56) References Cited

U.S. PATENT DOCUMENTS

| | | | | |
|---|---|---|---|---|
| 6,675,411 | B1 | 1/2004 | Javier | |
| 6,820,292 | B2 | 11/2004 | Heimbrock | |
| 6,834,402 | B2 | 12/2004 | Hanson et al. | |
| 9,248,064 | B2 | 2/2016 | Hillenbrand, II et al. | |
| 9,320,667 | B2 | 4/2016 | Tilk et al. | |
| 2013/0340167 | A1* | 12/2013 | Karwal | A61G 7/012 5/611 |
| 2016/0310338 | A1* | 10/2016 | Wunderlich | A61G 7/1048 |
| 2019/0307618 | A1* | 10/2019 | Borges Belza | A61G 7/1036 |

* cited by examiner

AUTOMATED ADJUSTMENTS FOR PATIENT SUPPORT APPARATUS

CROSS-REFERENCE TO RELATED APPLICATION

This application claims priority to U.S. Provisional Patent Application Ser. No. 62/722,257, filed on Aug. 24, 2018, and which is incorporated by reference in its entirety.

BACKGROUND

Patient support systems facilitate care of patients in a health care setting. Exemplary patient support systems include patient support apparatuses such as hospital beds, stretchers, gurneys, cots, trolleys, and wheelchairs, as well as traditional chairs, seats, benches, and tables. Various adjustable or movable patient support apparatuses may include a base and a litter upon which the patient is ultimately supported. Patient support apparatuses often also have a lift system that may be used to raise and lower the litter, and thus the patient, relative to the base. The patient support apparatuses have the potential of being in numerous different positioning orientations as the litters and support components attached thereto typically have several sections, such as a fowler section, a seat section, and a foot section, with the fowler and foot sections being capable of articulation relative to the seat section.

In the day to day operations of medical facilities, patients may need to be transferred from one patient support system or patient support apparatus to another patient support system or patient support apparatus. In many instances, patients are not ambulatory. These patients may need to be moved with the supervision and/or assistance of nursing and medical staff, and the patient immobility may make the transfer process more complex than anticipated. For example, the two patient support apparatuses may not be properly aligned or in preferential positions with respect to one another, or they may be disposed at incompatible heights. Further, supporting features such as rails may not be in appropriate positions, and the patient support apparatuses may not be in ergonomic positions relative to the particular caregiver providing lifting assistance in the transfer process, which may lead to an overexertion by the caregiver. As such, there remains a need for improved patient transfer systems and methods with minimal physical lifting or handling from the caregiver.

BRIEF DESCRIPTION OF THE DRAWINGS

The present teachings will become more fully understood from the detailed description and the accompanying drawings, wherein.

It should be noted that the figures set forth herein are intended to exemplify the general characteristics of the systems, methods, and devices among those of the present technology, for the purpose of the description of certain aspects. These figures may not precisely reflect the characteristics of any given aspect, and are not necessarily intended to define or limit specific embodiments within the scope of this technology. Further, certain aspects may incorporate features from a combination of figures, while other aspects may incorporate only portions of features from a single figure.

DETAILED DESCRIPTION

The present technology generally provides automated systems and methods for coordinating a transfer of a patient between two patient support apparatuses. When transferring a patient from one patient support apparatus to another, various considerations are often thought-out in order to have a preferential configuration of a patient support surface of a transferring support apparatus relative to a patient support surface of a receiving support apparatus. In various aspects, the present technology provides systems and methods for determining advantageous patient transfer positions of an occupied transferring patient support apparatus and an unoccupied receiving patient support apparatus. The technology provides automated methods of driving one or both of the transferring and receiving patient support apparatuses into preferred or optimal positions prior to the transfer the patient, with minimal adjustment of the apparatuses provided by the caregiver.

Figure 1:
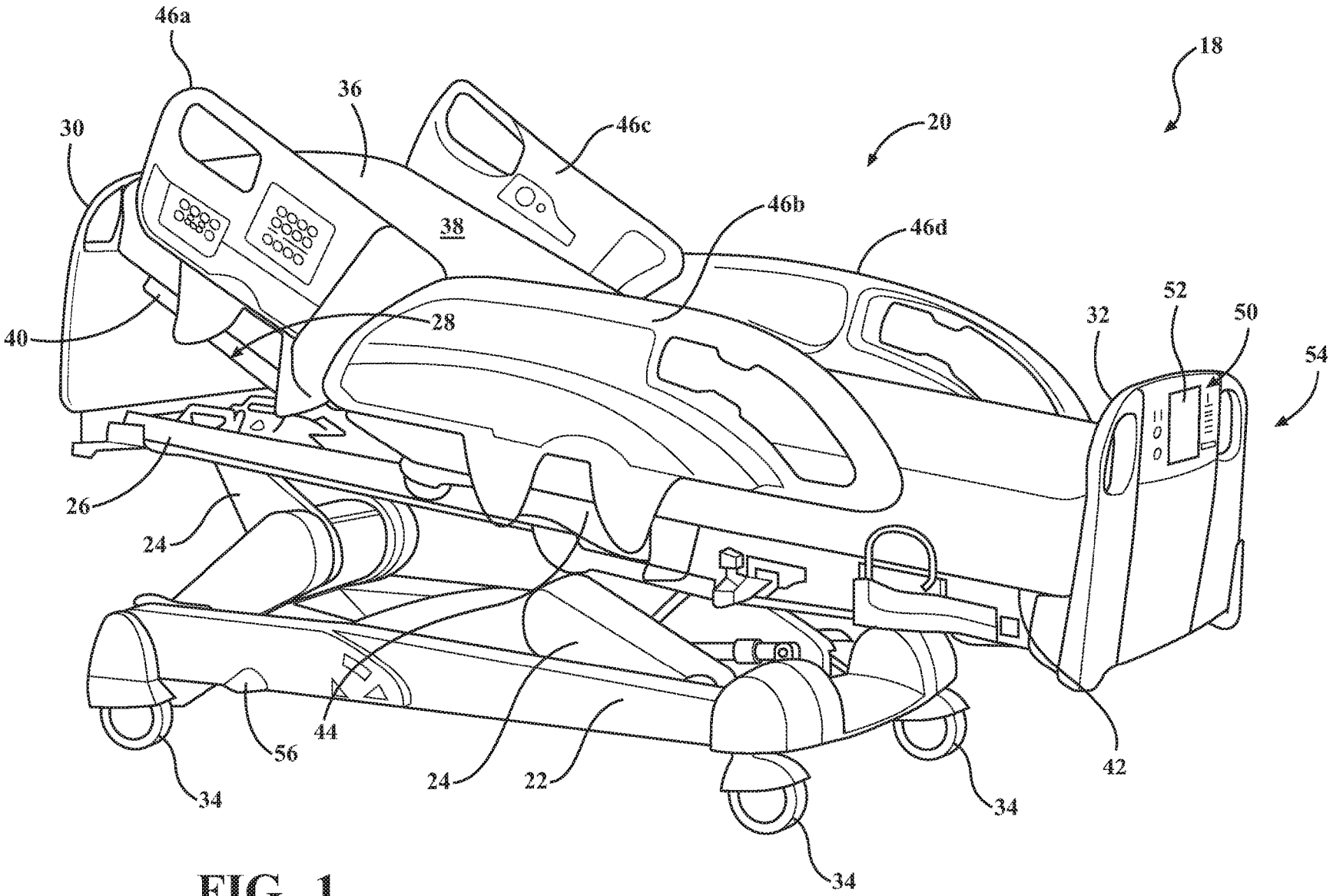
FIG. 1 is side perspective view of a patient support apparatus provided as a gatch-type hospital bed.
Figure 2:
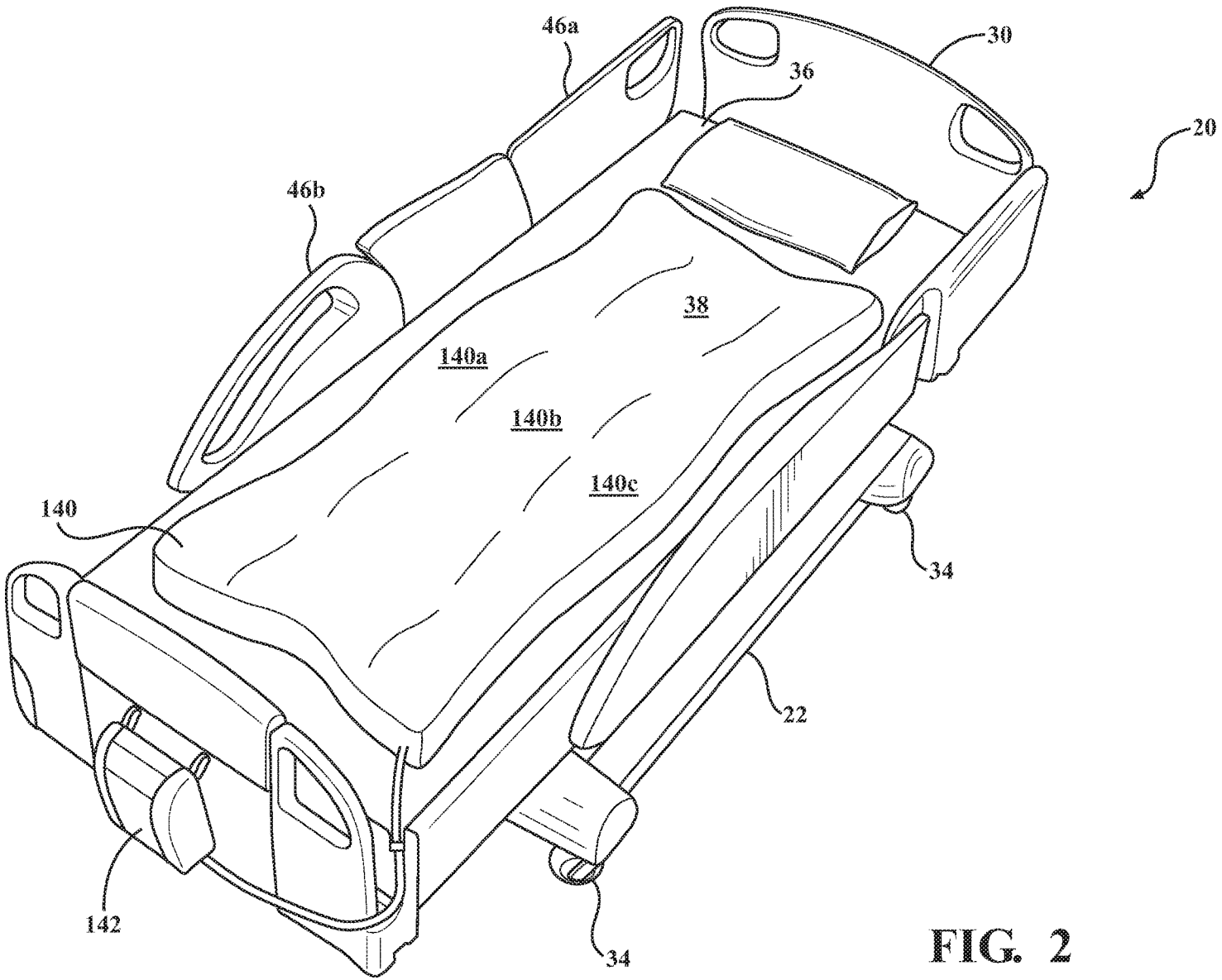
FIG. 2 is perspective view of a patient support apparatus provided as a gatch-type hospital bed, including an inflatable auxiliary transfer aid device.

For a more complete understanding of the present teachings, initial reference is made to FIGS. 1-2, illustrating examples of a patient support apparatus 18 with an adjustable frame that is configured as a bed 20 and generally adapted for use in a hospital or other medical setting. FIG. 1 is a side perspective view of a first exemplary bed 20 with a raised head section; FIG. 2 is a side perspective view of a second exemplary bed in a horizontal position. Although the particular form of patient support apparatus illustrated in FIGS. 1-2 is a bed, it should be understood that patient support apparatuses useful with the present technology may include, in different embodiments, stretchers; gurneys; cots; trolleys; operating tables; benches; wheelchairs, as well as traditional chairs, seats, and recliners; or any other similar type of structure capable of supporting a patient, whether stationary or mobile and/or whether used for medical or residential environments. In still other aspects, the patient support apparatus may be configured to change in shape and function, for example, between a stretcher or bed and a chair.

The exemplary gatch-type hospital bed 20 as shown in FIGS. 1-2 includes a base 22, an automated drive system such as a pair of lifts 24, an adjustable frame commonly referred to as a litter 26, a patient supporting deck 28, a headboard 30, and a footboard 32. The base 22 includes a plurality of wheels 34 that can be selectively locked and unlocked so that, when unlocked, the patient support apparatus 18 is able to be wheeled to different locations. Certain of the wheels 34 may be steering type wheels, with castors or otherwise configured to rotate up to 360 degrees, other wheels may not be rotatable. The base 22 may include one or more retractable wheels (not shown) to provide controlled traction and cornering. As will be discussed in more detail below, the base 22 may also include on or more powered wheels, the movement of which can be operated by a controller. Certain wheels 34 may be provided with locking mechanisms (not specifically shown). The lifts 24 are generally configured to raise and lower the litter 26 with respect to the base 22. In this regard, the lifts 24 may include hydraulic actuators, electric actuators, or any other suitable device for raising and lowering the litter 26 with respect to the base 22. In some embodiments, the lifts 24 may operate independently so that the orientation of litter 26 with respect to the base 22 may also be adjusted. The lifts 24 may be of various designs; certain lifts 24 are configured to raise and lower extending legs or columns in a substantially vertical direction, while others include hinges or scissor type lift mechanisms having linked, folding supports in a crisscross or 'X' pattern.

The litter 26 of the bed 20 of FIG. 1 provides a structure for coupling with the supporting deck 28, a headboard 30, and a footboard 32. The supporting deck 28 provides a surface on which a mattress 36, or other support member, is positioned defining a patient support surface 38 where a patient may lie and/or sit thereon. The supporting deck 28 may be made of a plurality of sections, some of which are pivotable about generally horizontal pivot axes. In the embodiment shown in FIG. 1, the supporting deck 28 includes a head section 40, a foot section 42, and one or more intermediate sections 44. The head section 40, which is also sometimes referred to as a fowler section, is pivotable with respect to the intermediate section 44 between a generally horizontal orientation (shown in FIG. 2) and a plurality of raised positions (one of which is shown in FIG. 1). The foot section 42, which is also sometimes referred to as a gatch section, is also pivotable with respect to the intermediate section 44 between a generally horizontal orientation (shown in FIGS. 1-2) and a plurality of lowered positions (not shown). In certain aspects, the head section 40 may be lowered, and the foot section 42 may be raised or elevated, with respect to the intermediate section 44, for example to increase blood flow to the upper body. The base 22, the lifts 24, the litter 26, the supporting deck 28 and its various sections 40, 42, 44, as well as other movable components, may each be provided with the necessary mechanical structures, actuators, automated drive mechanisms, etc. for exhibiting independent and automated movement, control, and related capabilities in order to provide various preferential transfer configurations of the patient support apparatuses 18.

The various patient support apparatuses 18 may also include a plurality of side rails, collectively referred to by reference number 46. For example, the bed of FIG. 1 includes a right head side rail 46*a*, a right foot side rail 46*b*, a left head side rail 46*c*, and a left foot side rail 46*d*. The side rails 46 are generally movable between a raised position and a lowered position, and in various aspects can be locked or provided at intermediate positions. The side rails 46 can be provided with handle areas for use by the patient or caregiver. In the configuration shown in FIGS. 1-2, all four of the side rails 46 are raised. As shown in FIG. 1, the interior side of the head side rails 46*a*, 46*c* may be provided with a patient control interface 48 configured to operate movement of the head section 40 and foot section 42, as well as control other auxiliary features, such as lights, televisions, sound control, and the like. The exterior side of the head side rails 46*a*, 46*c* may be provided with a caregiver control interface 50, similarly configured to operate movement of the bed 20, as well as other functions.

As shown in FIG. 1, the footboard 32 may also be provided with one or more caregiver control interface 50 and/or display 52 with optional touchscreen capabilities. In certain aspects, the footboard 32 may include a controller 54 that includes the caregiver control interface 50 and display 52. The controller 54 may include at least one processor with memory and software programmable to control various aspects of the bed 20. The teachings of the present technology may be used with known control systems and may generally include a computing device or controller 54, such as a control module with a processor, a memory, and an interface 50. It should be understood that although particular systems or subsystems may be separately defined herein, each or any of the systems may be otherwise modified, combined, or segregated via appropriate hardware and/or software as is known to those of ordinary skill in the art. The controller 54 may be a portion of another control device, a stand-alone unit, or other system, including cloud based. Alternatively, the controller 54 can be composed of multiple computing devices. The processor(s) may be any type of conventional microprocessor having desired performance characteristics and capable of manipulating or processing data and other information. The memory may include any type of computer readable medium that stores data and control algorithms described in more detail below. Other operational software for the processor may also be stored in the memory. The interface may facilitate communication with other systems, sensors, and other on-board systems. On-board systems and sensors may include, but are not limited to, weight sensors, diagnostic sensors, auxiliary systems and accessories, automated controls, and the like. The controller 54 can also include secondary, additional, or external storage, for example, a memory card, flash drive, or any other form of computer readable medium. Installed applications can be stored in whole or in part in the external storage and loaded into the memory as needed for processing.

In various aspects, the controller 54 may be located out of view, for example, secured in the base 22 or coupled to the litter 26, as appropriate. The controller 54 may alternatively be an external unit that is wired to the bed 20 or communicates via wireless communication. Thus, the bed 20 may also be provided with one or more communication module configured to establish a wireless communication. Various wireless communication protocols may be used, including Bluetooth, near-field communication (NFC), infrared communication, radio wave communication, cellular network communication, and wireless local area network communication (Wi-Fi). In certain aspects, the communication module may be a part of the controller 54. The wireless communication may provide compatibility with information management systems. Not only can the patient support apparatuses 18 be coupled to the controller 54 using wireless communication protocols, one or more patient support apparatuses 18 can establish a communication link directly or indirectly with one another in order to share data, information, and exhibit control.

Figure 3:
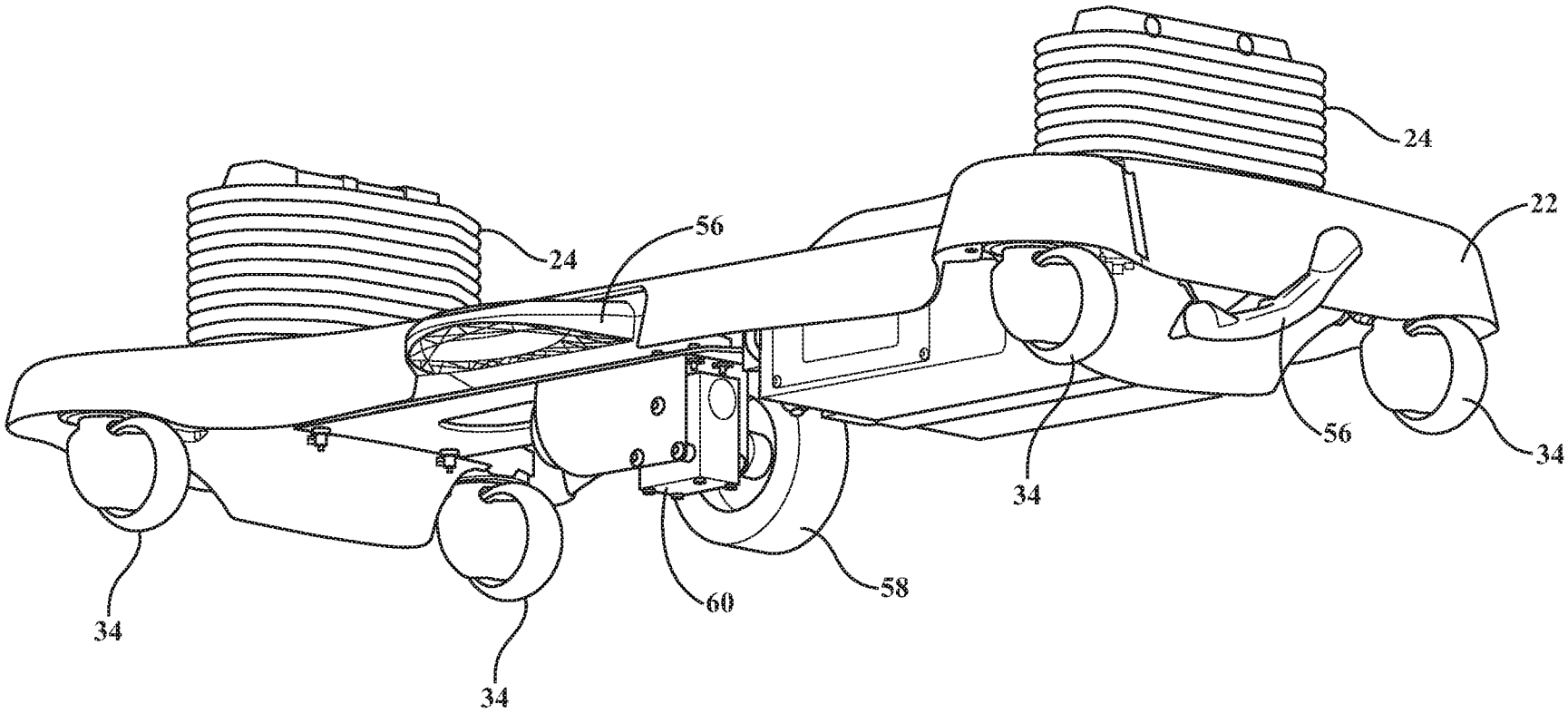
FIG. 3 is a bottom perspective view of an alternative base configured to be used with a hospital bed, cot, or stretcher patient support apparatus according to the present technology.

FIG. 3 illustrates a side-bottom perspective view of an alternative type of base 22 that can be used with the beds of FIGS. 1-2, as well as with other structures according to the present technology, such as cots, stretchers, and the like. As shown, the base 22 includes a set of wheels 34 disposed adjacent the four corners of the base 22, as well as various brake pedals 56 configured to actuate manual or electrically actuated brakes. Two lifts 24 are similarly provided, generally configured to raise and lower a litter 26, or other structural component, with respect to the base 22. The base 22 of FIG. 3 additionally includes at least one larger powered wheel 58 and an appropriate drivetrain mechanism 60. The larger powered wheel 58 may be operated in conjunction with handles, a user interface, and/or the controller 54, and can assist a caregiver to move the bed 20. For example, the larger powered wheel 58 may reduce start-up forces and steering efforts. It should be understood that in addition to the larger powered wheel 58, it is also envisioned that one or more of the other wheels 34 may also be provided with a driver, such as a solenoid, magnet, or the like with an actuator that can be turned on and off for control of the wheel 34. As discussed in more detail below, one or more of the wheels 34, 58 may also be used for autonomous movement.

The physical construction of any of the base 22, the lifts 24, the litter 26, the supporting deck 28, the headboard 30, the footboard 32, and/or the side rails 46 may alternatively be similar to that as disclosed in commonly assigned, U.S. Pat. No. 7,690,059 issued to Lemire et al., and entitled HOSPITAL BED; or as disclosed in commonly assigned U.S. Pat. No. 8,689,376 issued to Becker et al. and entitled PATIENT HANDLING DEVICE INCLUDING LOCAL STATUS INDICATION, ONE-TOUCH FOWLER ANGLE ADJUSTMENT, AND POWER-ON ALARM CONFIGURATION; or as embodied in the commercially available S3 bed sold by Stryker Corporation of Kalamazoo, Mich., and documented in the Stryker Maintenance Manual for Stryker's MedSurg Bed, Model 3002 S3, (doc. 3006-609-002 Rev D), published in 2010, the complete disclosures of each of which is hereby incorporated herein by reference. It should also be understood that the construction of any of base 22, lifts 24, frame/litter 26, deck, headboard 30, footboard 32 and/or side rails 46 may also take on forms different from what is disclosed in these documents.

Figure 4:
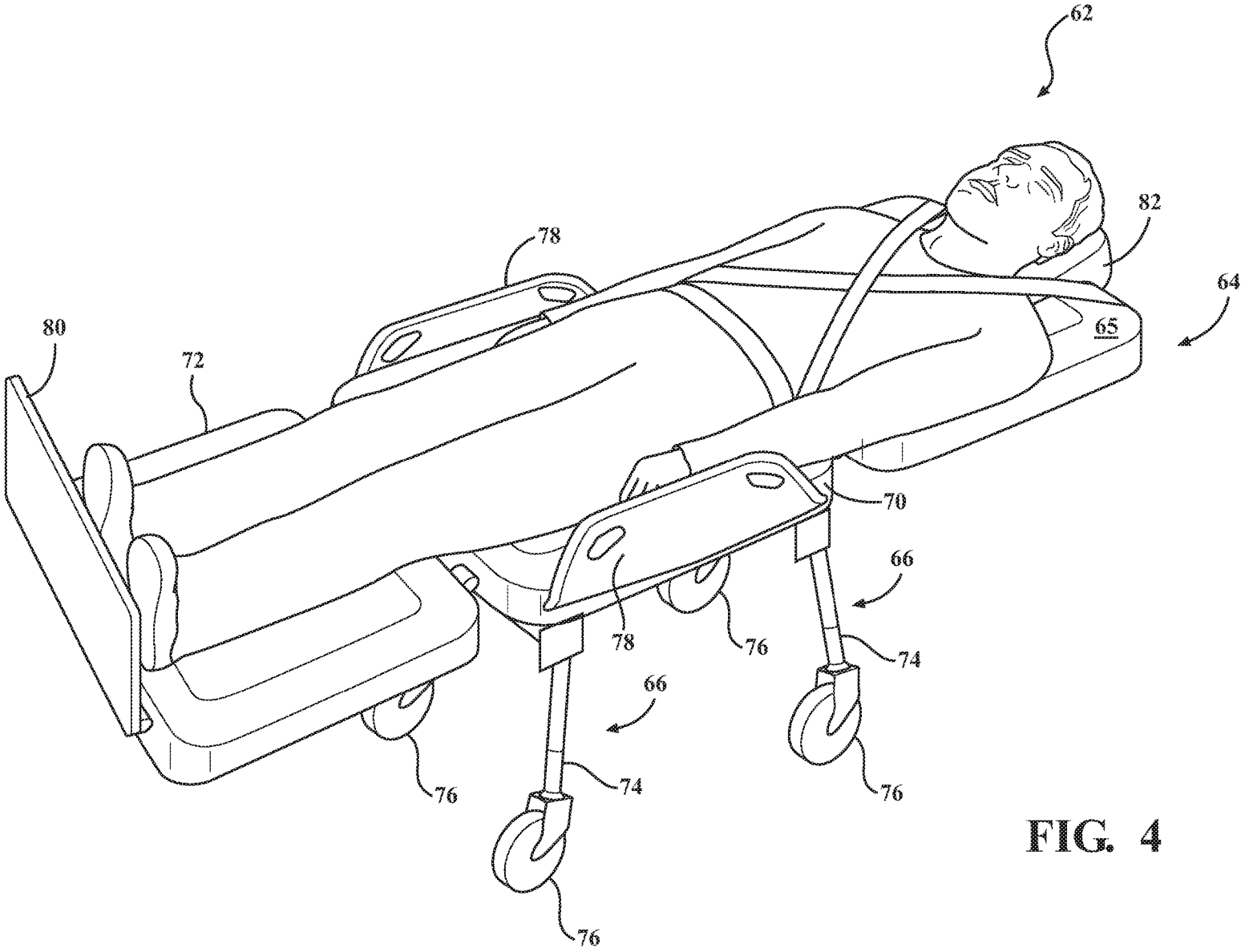
FIG. 4 is a side perspective view of a configurable patient support apparatus provided as a stretcher.
Figure 5:
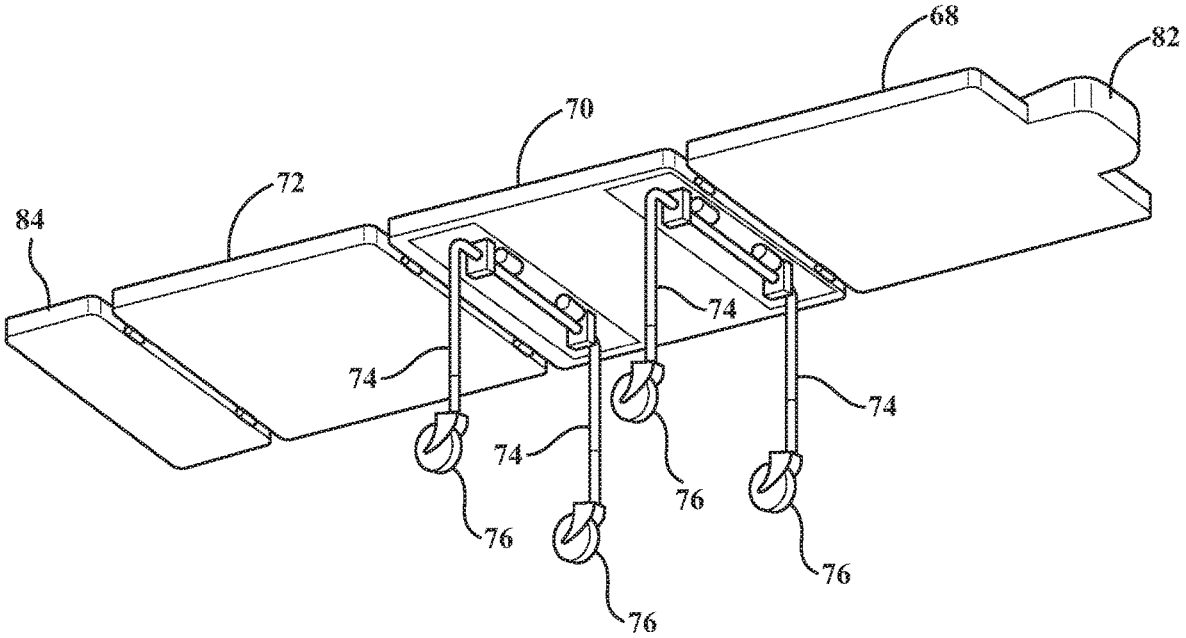
FIG. 5 is a perspective view of the stretcher of FIG. 4 showing an underside of the deck structure.
Figure 6:
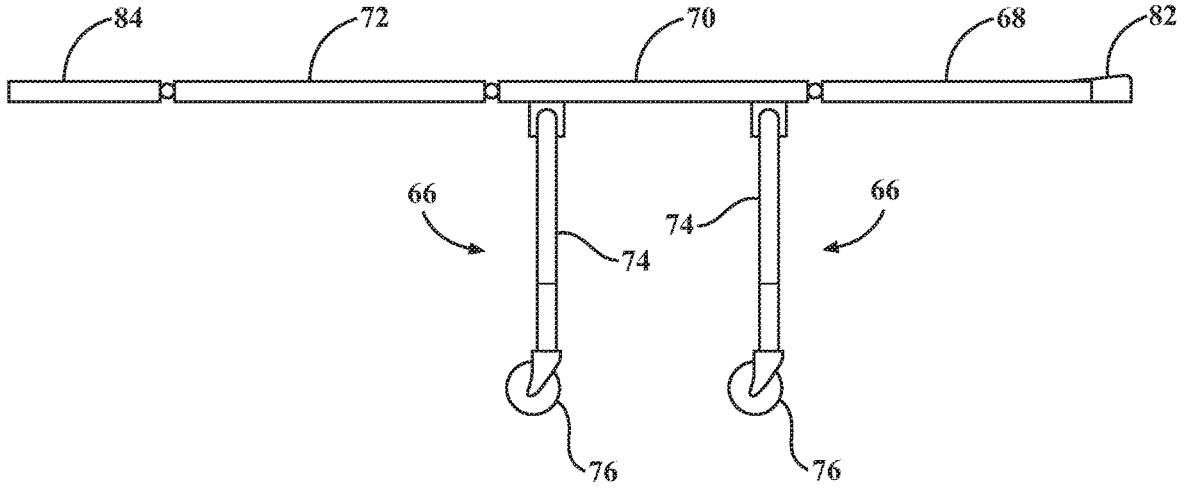
FIG. 6 is a side plan view of the stretcher of FIGS. 4-5.

FIG. 4 illustrates an example of a patient support apparatus 18 with an adjustable frame that is configured as a cot or stretcher 62 and generally adapted for use with EMS transportation or transportation in a hospital or other medical setting. FIG. 5 illustrates a bottom perspective view of the stretcher of FIG. 4; FIG. 6 illustrates a side plan view of the stretcher 62 of FIG. 4. Similar to the bed 20, the stretcher 62 may include a supporting deck 64 and lifts 66 to raise and lower the supporting deck 64 at various height positions. The supporting deck 64 provides a patient support surface 65 where a patient may lie and/or sit thereon, or upon which an optional mattress or other support member (not shown) may be positioned defining the patient support surface 65. The supporting deck 64 may be articulatable and be provided with various sections, such as a fowler or back section 68, a seat or intermediate section 70, and a leg section 72. In various aspects, the back section 68 and leg section 72 are pivotally coupled to opposing ends of the intermediate section 70. The lifts 66 may include a plurality of extending legs 74 and wheels 76. Certain of the wheels 76 may be steering type wheels, on castors or otherwise configured to rotate up to 360 degrees, other wheels may not be rotatable. Certain wheels 76 may be provided with drivers and/or locking mechanisms (not specifically shown). The legs 74 may be substantially vertical, or slightly angled with respect to the supporting deck 64. Similar to the lifts 24 described above but not shown for simplicity, the lifts 66 may include hydraulic actuators, electric actuators, or any other suitable device for raising and lowering the supporting deck 64. The lifts 66 may be of various designs; certain lifts 66 are configured to raise and lower extending legs in a substantially vertical direction, while others include hinges or scissor-type lift mechanisms having linked, folding supports in a crisscross 'X' pattern. When scissor-type mechanisms are provided, they are generally in the same plane as the supporting deck 64 when folded. Movable side rails 78, a footboard 80, and a head support section 82 may be provided. Optionally, the stretcher 62 may include a separate pivotable foot section 84 may be provided as shown in FIGS. 5 and 6. Although not shown for simplicity, a controller and communication module may similarly be provided with the stretcher 62.

Figure 7:
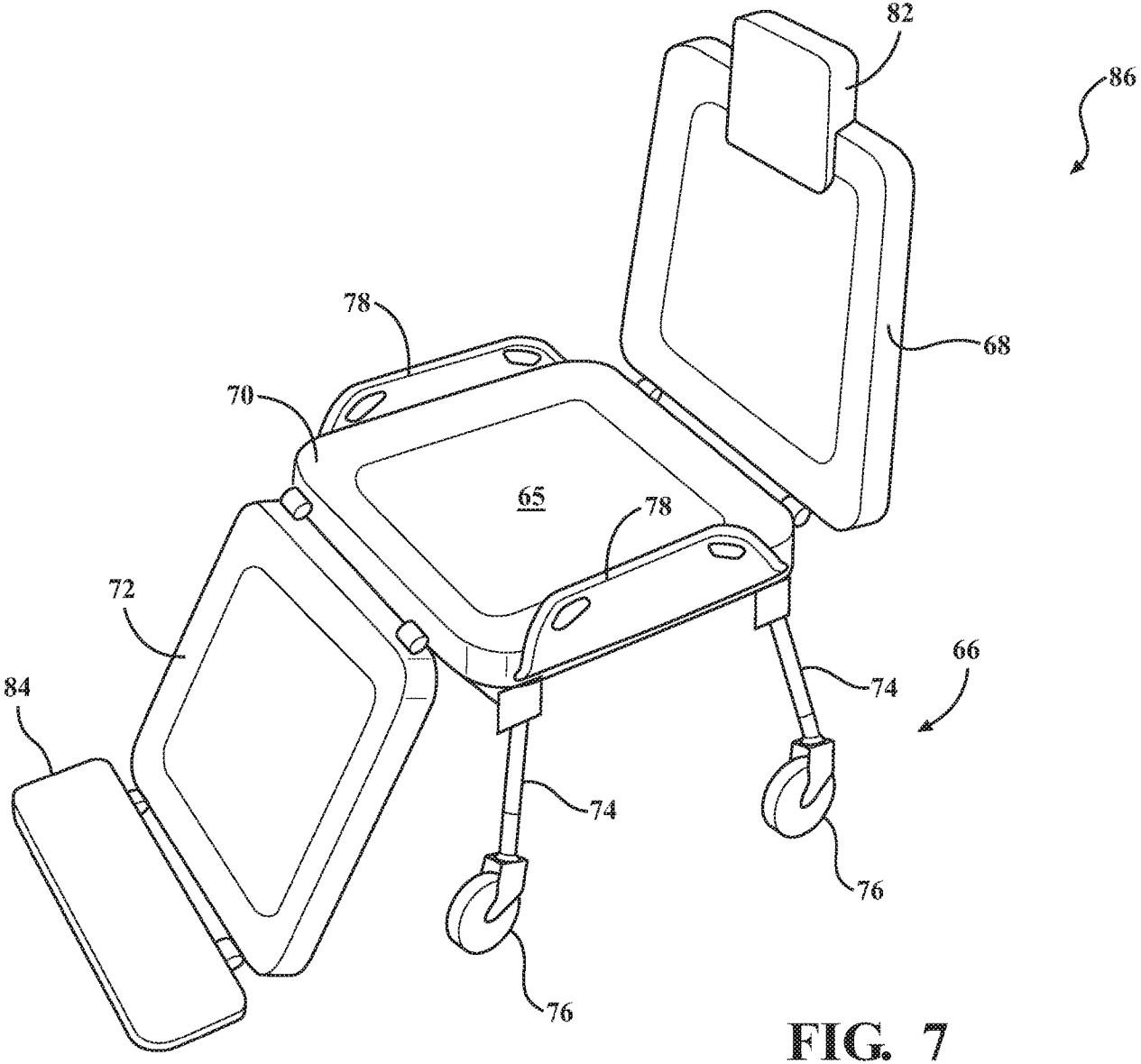
FIG. 7 is a perspective view of the configurable patient support apparatus of FIGS. 4-6 provided as a wheeled chair.

FIG. 7 illustrates the stretcher 62 of FIGS. 4-6 arranged with the adjustable frame in a configuration operable as a wheeled chair 86. As shown, the supporting deck 64 is arranged with the back section 68 substantially in an upright position, with the leg section 72 lowered. The lifts 66 can provide the legs 74 at a height suitable for use as a wheeled chair 86.

Figure 8:
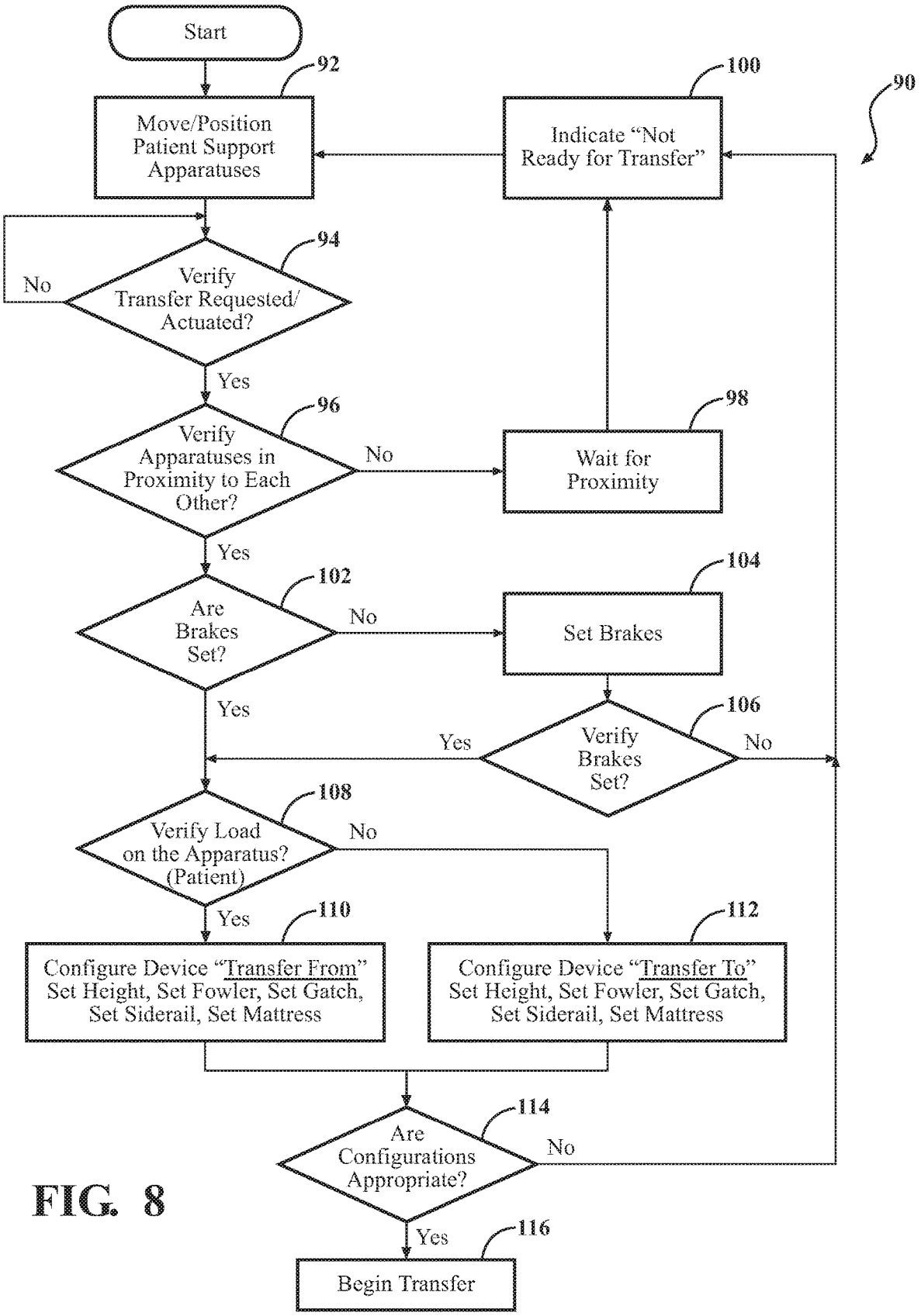
FIG. 8 provides an exemplary flowchart that illustrates the basic framework for the automated systems and methods for coordinating a transfer of a patent between two support apparatuses according to various aspects of the present technology.

FIG. 8 provides an exemplary flowchart 90 that illustrates the basic framework for the automated systems and methods for coordinating a transfer of a patent between two support apparatuses according to various aspects of the present technology. Non-limiting features performed as illustrated in the flow chart may relate to positioning the patient support transfer apparatuses; activating or commencing a transfer request; performing various safety checks and load checks; configuring the patient support apparatuses; and ultimately transferring the patient. While the flowchart 90 provides a certain path of steps and features, as well as an order that may be followed for illustration purposes, it should be understood that the methods of the present technology should not be interpreted as having a fixed order of steps, features, or procedures, and various steps, features, and procedures can be performed in different orders of operation, at different stages, and by different patient support apparatuses. Further, certain features may be performed repeatedly or monitored continuously. Various functions, methods, features, and steps are disclosed in terms of block diagrams with decision trees. However, it should be understood that certain of these functions may be enacted or performed in dedicated hardware circuitry or programmed software routines as a computer readable storage medium capable of execution as instructions in a microprocessor-based electronics control embodiment, such as a control system or controller, as will be discussed below. Memory is one example of a non-transitory computer-readable medium/storage media having embodied thereon computer-useable instructions that, when executed, may coordinate and/or perform one or more method feature according to the present technology.

In various aspects, the methods may begin by locating the two patient support apparatuses that will be involved in the transfer, and coordinating an initial movement and positioning of at least one patient support apparatus as indicated by method feature 92. The two patient support apparatuses may be manually selected, or they may be selected using an automated process. For example, in the event there is more than one patient support apparatus available for use, considerations may be made with respect to the type or kind of patient support apparatus preferred; the current position of both apparatuses relative to one another; the range of motion of each apparatus; the type of mattresses and/or patient support surfaces provided; and the availability of any accessories that may be of assistance. Depending on the particular patient and case-by-case considerations, it may be preferable to move the patient from a left-to-right direction, or from a right-to-left direction. Thus the types and relative locations of the two patient support apparatuses may need to be considered and/or approved by a caregiver for the patient transfer to take place.

In certain aspects, the systems and methods described herein may include a feature of requesting or activating the transfer process as indicated by method feature 94. In certain aspects, confirmation of a request for transfer may be a prerequisite before the remainder of the transfer process continues. In one non-limiting example, this may include the use of a "transfer" button that may be provided on a user interface, or the like, for verification purposes.

The systems and methods of the present technology include various safety checks and safety considerations during the various stages of the transfer process. As indicated by method feature 96, the methods may include checking that the patient support apparatuses are at all relevant times in sufficient proximity to one another. As indicated by method feature 98, if the patient support apparatuses become separated more than a threshold distance from one another, the method may stop or pause, waiting for the apparatuses to again have the proper proximity. As indicated by method feature 100, the system may be configured to provide a visual or audio indication that the apparatuses are not ready to continue with the transfer process. In certain examples, this may require the involvement and/or override by a caregiver or other user. Similarly, as indicated by method feature 102, the methods may include checking that the brakes of patient support apparatuses are at all relevant times are properly set, engaged, or locked. As indicated by method feature 104, if the brakes become unlocked, they may be reset or reengaged and subsequently verified as indicated in method feature 106. The method may stop or pause, waiting for the apparatuses to again have the proper brake settings as necessary. Similarly, as indicated by method feature 100, the system may be configured to provide a visual or audio indication that the apparatuses are not ready to continue with the transfer process if there is an error with the brakes or if the brake settings are not appropriate for the transfer process. Additional relevant safety checks that may be monitored may include erecting or locking a side rail, receiving an indication that the two apparatuses remain properly coupled (as explained in more detail below), and receiving an indication that any spatial gaps between the two apparatuses is minimized or removed (also as explained in more detail below).

Once the apparatuses are aligned and positioned, and the various safety checks are in order, the methods may include performing a load check in order to verify the presence of the patient, as indicated by method feature 108. As shown in the simplified flowchart, the presence of a load will likely indicate the apparatus is a transferring patient support apparatus, and will permit various changes to movable components of the patient support apparatus as indicated by method feature 110. Alternatively, the absence of a load will likely indicate the apparatus is a receiving patient support apparatus, and will permit various changes to movable components of the patient support apparatus as indicated by method feature 112. Further details of the assignment of the patient apparatuses with a status of a transferring or receiving apparatus will be discussed in more detail below. Various configurations and settings may be monitored throughout the transfer process as indicated by method feature 114. If any of the configurations or settings of the patient support apparatuses are determined to be inappropriate or in error, the system may be configured to provide a visual or audio indication that the apparatuses are not ready to continue with the transfer process as indicated by method feature 100. Once the apparatuses are properly configured and all safety checks are complete, the transfer process can begin as indicated by method feature 116. In various aspects, an indication is provided to a caregiver or user that it is safe to transfer the patient between the two patient support apparatuses. For example, the systems may provide an audio or visual indication to a caregiver indicating that at least one or more safety feature is met.

As briefly mentioned above, at least one patient support apparatus may be equipped with a controller 54 and/or a communication module configured to communicate and/or otherwise exchange general information and specifications. In the event one of the patient support apparatuses is a passive device, for example, without any controller or communication module, the controller 54 of the other patient support apparatus may be configured to ascertain a model number, or equivalent identification of the passive device. In other instances, the passive device may be provided with a beacon, an RFID device, or an equivalent mechanism to broadcast identifying information, current setting or configuration information, and/or specifications to the controller 54. A caregiver may also manually provide certain identifying information as required. In aspects where both patient support apparatuses include a controller or communication module, the methods may include establishing a communication link between the two patient support apparatuses. As described above, the communication may be established using at least one wireless protocol, such as Bluetooth, near-field communication (NFC), infrared communication, radio wave communication, cellular network communication, and wireless local area network communication (Wi-Fi).

Figure 9:
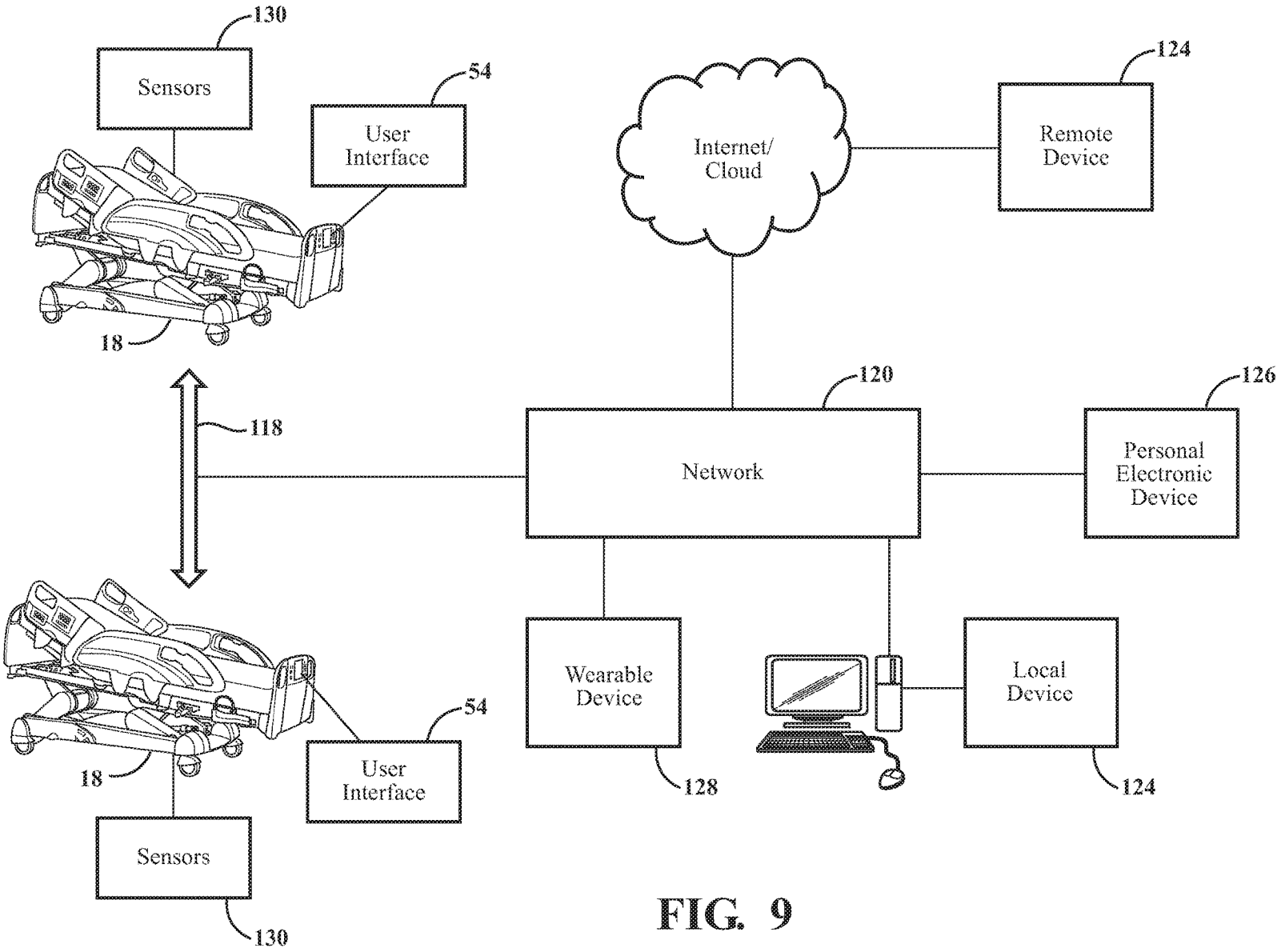
FIG. 9 provides an exemplary schematic diagram of various potential communication links that may be useful with the present technology.

FIG. 9 provides an exemplary schematic diagram of various potential communication links that may be useful with the present technology. In addition to establishing a communication link 118 between the two patient support apparatuses 18, the methods may also include establishing communication with a network/server 120, local computer system 122, or internet/cloud based remote systems 124. Still further, a communication link can also be provided with one or more computer application on a mobile device, such as a personal electronic device 126 operated by a patient or a caregiver. Exemplary personal electronic devices 126 may include a smart phone, tablet, or other mobile device. Wearable devices 128, such as a smart watch, smart bracelet, smart necklace, smart glasses, as well as passive RFID fobs, beacons, and the like may also be part of the communication system. The controller 54 may be coupled to a plurality of sensors 130 that may be incorporated within the respective patient support apparatuses 18. Non-limiting examples of such sensors 130 include weight sensors, height sensors, optical sensors, camera sensors, motion sensors, infrared sensors, distance sensors, accelerometers, positional sensors, proximity sensors, a GPS device, and combinations thereof.

Figure 10:
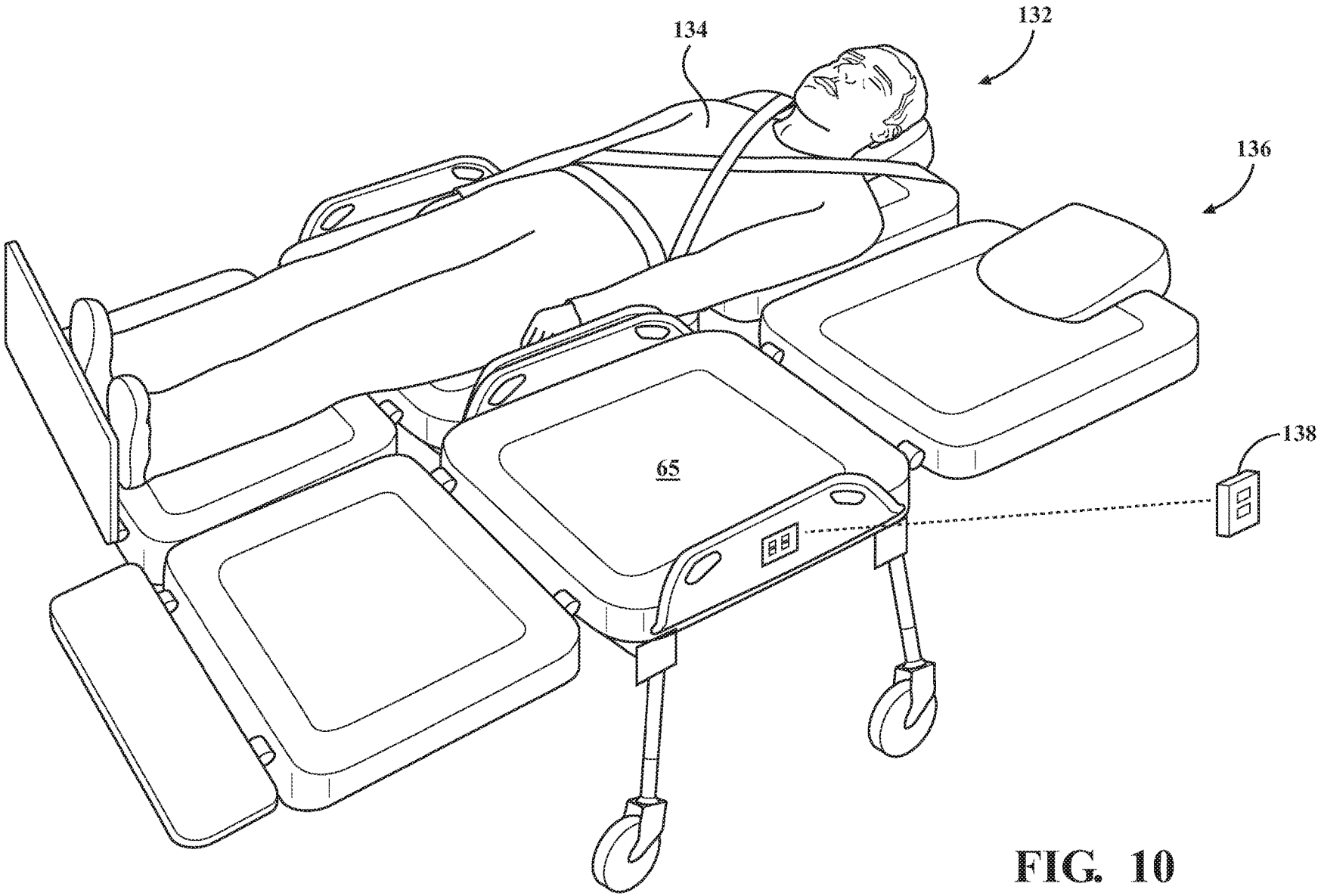
FIG. 10 illustrates one example of two patient support apparatuses located, aligned, and positioned adjacent one another in a longitudinally parallel and proximal configuration.

FIG. 10 illustrates one example of two patient support apparatuses 18 located, aligned, and positioned adjacent one another in a longitudinally parallel and proximal configuration. At various points throughout the methods, preferably in the early stages, it is useful to assign each of the two patient support apparatuses with a status as one of a transferring patient support apparatus 132 that currently includes the patient 134, and a receiving patient support apparatus 136 to which the patient 134 will be transferred to. Accordingly, the methods may include a step of identifying a location of the patient. In various aspects, for example, the step of identifying the location of the patient may include obtaining a weight sensor measurement from at least one of the two patient support apparatuses 132, 136. If the resulting weight measurement is indicative of the presence of a patient, the patient support apparatus can be assigned as the transferring patient support apparatus 132. Alternatively, if the resulting weight measurement is not indicative of a weight of a patient, the patient support apparatus can be assigned as the receiving patient support apparatus 136. It is envisioned that other types of sensors 130 can be used in addition to, or as an alternative to, the weight sensor to detect the location of a patient 134. For example, a camera, an optical sensor, an infrared sensor, a motion sensor, and the like may be configured to detect the presence or absence of the patient 134.

In certain aspects, the features of locating and aligning the transferring patient support apparatus 132 adjacent the receiving patient support apparatus 136 may include an autonomous movement of a location of at least one of the transferring patient support apparatus 132 and the receiving patient support apparatus 136 with respect to one another. For example, the controller 54 may be configured to operate at least one powered wheel 58, or similar automated drive mechanism to provide various movements and alignments. In certain aspects, the two patient support apparatuses can be placed in close proximity to one another, and a caregiver or user can initiate an automated process of the patient support apparatuses autonomously aligning with one another. Once located and aligned in the appropriate proximity with one another, the systems and methods may include checking the status of the brakes of one or both of the patient support apparatuses. In various aspects, the controller 54 may be provided with programmable instructions to engage, lock, and disengage a brake or similar safety feature that prevents or minimizes a movement of the patient support apparatuses. In other aspects, one or more brake can be configured to be engaged, locked, and disengaged remotely and/or manually.

Either before or after locating and aligning the transferring patient support apparatus 132 adjacent the receiving patient support apparatus 136, the present technology includes adjusting at least one position of a movable component of one or both of the transferring patient support apparatus 132 and the receiving patient support apparatus 136 in order to have a preferred configuration for transferring the patient 134. In various aspects, the patient support apparatuses are provided with one or more automated means of driving one or more movable components to particular configurations suitable for transferring a patient. Adjusting the position of a movable component may ultimately include repositioning a movable component with the ultimate purpose of adjusting an overall height of the patient support surface 38 or a portion thereof. In various aspects, this may include a movement of the lifts 24, shortening or extending a length of the legs 74, pivoting a movable structure coupled to the supporting deck 28, 64 such as a head section 40, a back section 68, a foot section 42, a leg section 72, etc.

In various aspects, adjusting a height position of at least one of the transferring patient support apparatus 132 and the receiving patient support apparatus 136 includes obtaining or measuring a current height of at least one of the transferring patient support apparatus 132 and the receiving patient support apparatus 136. If the heights cannot be obtained by the controller 54, the methods may include measuring the current height using at least one of an optical sensor, a displacement sensor, a magnetic (hall) sensor, or the like, located on the respective patient support apparatus. In other aspects, one or more current height may be manually provided as an input by a caregiver. If an actual height dimension cannot be obtained, relative differences in height between the two patient support apparatuses 132, 136 can be determined and the heights can be adjusted based on the relative difference. For example, if the patient support apparatuses use a column lift, a relative height difference between adjacent apparatuses can be determined using a hall sensor. Alternatively, if the patient support apparatuses use a scissor lift, it is envisioned that an optical sensor can measure an angle of the each of the lift mechanisms and determine a relative height difference based on the difference in angular measurements.

The height of the patient support surfaces may be adjusted in order to arrive at what is referred to herein as an optimal transfer height for the patient transfer process, which can reviewed and determined based on many different variables and patient-specific information. In addition to an optimal transfer height, there may be one or more optimal angular orientations of various movable components of the patient support apparatuses that ultimately have an influence on a position of at least a portion of a patient supporting surface.

In various aspects, algorithms and logic for the determination of an optimal transfer height and/or optimal angular orientations may be programmed in the controller 54 and may depend on the use of any auxiliary transfer aid devices. By way of non-limiting examples, the optimal transfer height may be based on one or more of a patient's: age, weight, height, medical condition, injury, cognitive state, the presence and location of dressings, the use of other medical equipment (IV fluid dispensers, catheters, medical electrodes and electrical contacts, etc.). Such patient-specific information may be manually entered by a care giver, or may be requested or obtained by one of the patient support apparatuses. In certain aspects, the patient support apparatus can use an internal sensor to determine a current weight or height of the patient. With renewed reference to FIG. 9, the patient support apparatus may also be in communication with various networks and computing devices that may have access to patient-specific information, medical records, and the like. In certain aspects, the patient-specific information can be programmed into a wearable device that is associated with the patient.

In addition to being based on patient-specific information, an optimal transfer height can additionally or alternatively be based in whole or in part using caregiver-specific information. In this regard, the optimal transfer height may be based on ergonomic conditions, or be based on a combination of information, such as patient weight along with strength and/or height of a caregiver, etc. Non-limiting examples of caregiver-specific information may include age, weight, waist height, and total height of the caregiver. In addition to physical characteristics, caregiver-specific information may also include information such as gender, occupation (nurse, assistant, orderly), years of experience, maximum desired lifting capacity, lift restrictions, etc. In certain aspects, the caregiver-specific information can be manually entered, programmed into a wearable device that is associated with the caregiver, or otherwise retrieved through the controller 54. It is also envisioned that the patient support apparatus may include one or more camera or optical sensor 138 (FIG. 10) that is configured to measure, estimate, or otherwise obtain a height of a caregiver.

In various aspects, the optimal transfer height of the two patient support apparatuses may be such that the height of the patient support surface of the receiving patient support apparatus 136 be slightly lower than the height of the adjacent patient support surface of the transferring patient support apparatus 132. In this regard, it may be easier to transfer the patient 134 in a downward movement as well as a lateral movement between the two patient support apparatuses.

Once the patient support apparatuses are configured with movable components at appropriate positions and with an appropriate height of the patient support surfaces, the systems and methods of the present technology may include coupling the two patient support apparatuses together to minimize or prevent unintended relative movement between the apparatuses. In various aspects, portions of the respective bases 22, legs 74, side rails 46, 78, wheels 34, 76, or other suitable components of the adjacent patient support apparatuses may be temporarily coupled to one another. In various aspects, the coupling can be accomplished using a mechanical or magnetic coupling mechanism. The coupling (and subsequent uncoupling) may be manually engaged, remotely controlled, or be operated by an algorithm or programmable instructions in the controller 54 or equivalent control mechanism. Non-limiting examples of mechanical couplings may include the use of latches, gripping mechanisms, and the like. Where magnetic coupling mechanisms are used, they may preferably include electromagnets that can be actuated in a controlled manner. Electromagnets having an appropriately selected strength may be attached to various locations on the respective bases 22, legs 74, side rails 46, 78, wheels 34, 76, or other suitable components of the adjacent patient support apparatuses. Once the patient has been transferred, the receiving patient support apparatus can be uncoupled from the transferring patient support apparatus.

In various aspects, the systems and methods of the transferring the patient may include the use of one or more auxiliary transfer aid device configured to assist with a movement of the patient. Non-limiting examples of auxiliary transfer aid devices, also called lateral sliding aids, presently considered useful with the present technology include an adjustable air bladder, a sheet transfer device, an anchor body wedge system, and/or a bridge transport device.

With renewed reference to FIG. 2, the bed 20 includes one non-limiting example of an adjustable air bladder 140 having a plurality of internal air passages 140*a*, 140*b*, 140*c* that can optionally be filled with air. An appropriate inflation device 142 can be used to fill one or more of the passages 140*a*, 140*b*, 140*c* to various levels of inflation. The physical construction of the adjustable air bladder 140 may alternatively be similar to that as disclosed in U.S. Pat. App. Pub. No. 2017/0326011 by Alvarez et al., and entitled PATIENT SUPPORT APPARATUS, assigned to Sage Products, LLC; or as disclosed in U.S. Pat. No. 9,849,053 issued to Rigoni et al. and entitled APPARATUS AND SYSTEM FOR BOOSTING, TRANSFERRING, TURNING AND POSITIONING A PATIENT, also assigned to Sage Products, LLC, the complete disclosures of each of which is hereby incorporated herein by reference. In various aspects, the air bladder 140 can be inflated in phases, for example, in order to elevate at least one side of the patient in order to assist with the lateral transfer of the patient. In this regard, the air bladder 140 may remain on the transferring patient support apparatus after the patient is eased onto the receiving patient support apparatus. Still in other aspects, the entire air bladder 140 may be filled to serve as a cushion of air that enables the lateral transfer of the patient with significantly less pulling and potentially without the need for lifting. In this regard, the air bladder 140 may transfer with the patient to the receiving patient support apparatus. The air bladder 140 may include a plurality of grips or integrated handles on each side configured for use by a caregiver for laterally pulling the patient (not shown).

Figure 11:
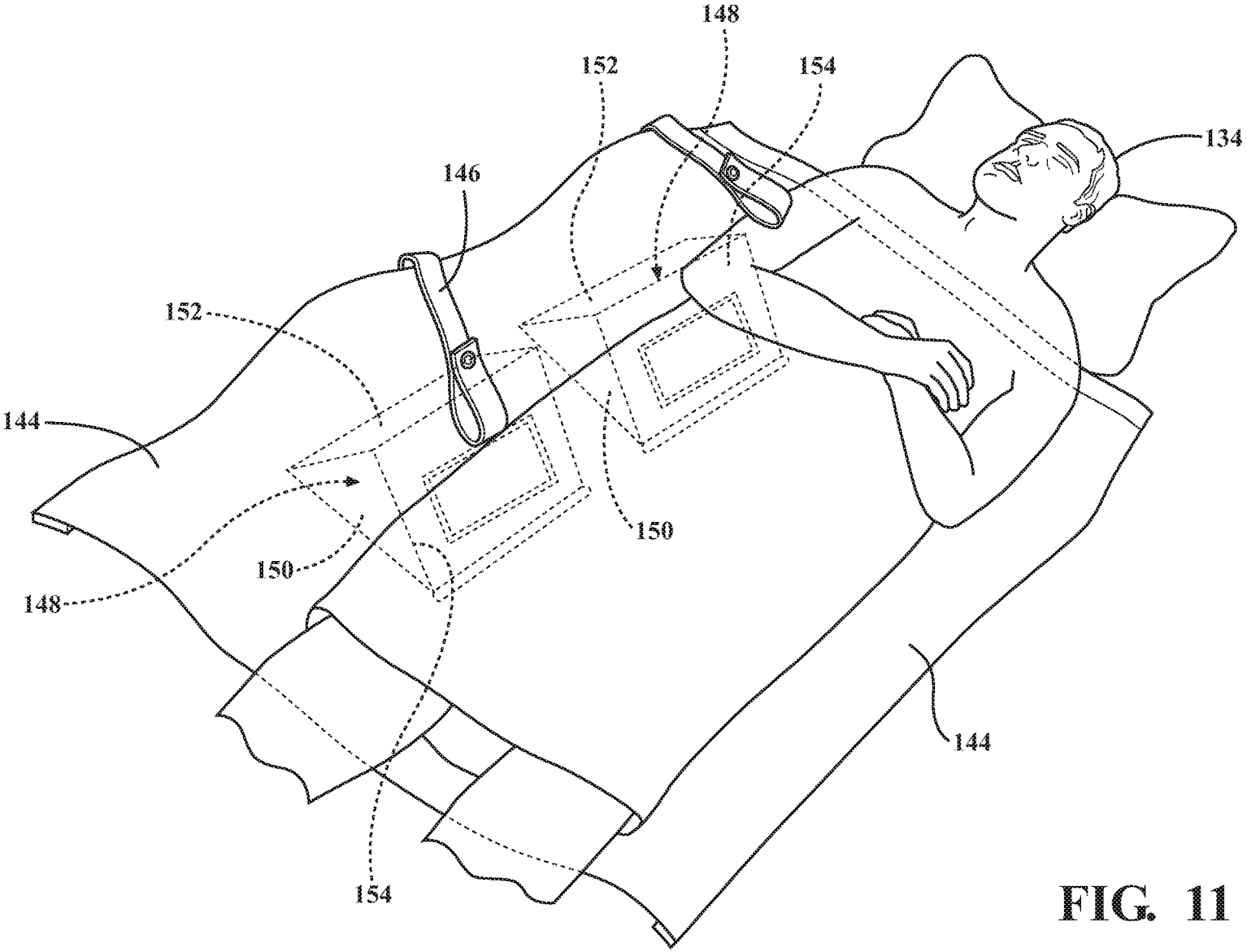
FIG. 11 illustrates additional auxiliary transfer aid devices useful with the transfer of a patient.

FIG. 11 illustrates a sheet transfer device 144 and an anchor body wedge system optionally useful as auxiliary transfer aid devices useful with the transfer of a patient. Exemplary sheet transfer devices 144 may include low friction or friction reducing sheets that can be placed under a patient 134 or even under another transfer device, such as an air bladder 140 as described above. Sheet transfer devices 144 may similarly include a plurality of grips 146 or integrated handles on each side configured for use by a caregiver for laterally pulling the patient (not shown). Sheet transfer devices 144 are generally intended to move with a patient 134 from one patient support apparatus to another. The anchor body wedge system as illustrated in FIG. 11 may include one or more individual anchor body wedges 148 that may optionally be used to support a patient 134 at an elevated position that may be useful during the transfer process. The anchor body wedges 148 may generally be triangular in shape and provide a ramp and support to slide and position the patient 134 on his/her side. The anchor body wedges 148 may include or define a bottom or base wall 150, a side wall 152, and a front wall 154 providing a ramp surface. The anchor body wedges 148 may be used alone or in combination with other auxiliary transfer aid devices.

The physical construction of the sheet transfer device 144 or anchor body wedges 148 may alternatively be similar to that as disclosed in U.S. Pat. App. Pub. No. 2017/0296414 by Fowler et al., and entitled APPARATUS AND SYSTEM FOR TURNING AND POSITIONING A PATIENT, assigned to Sage Products, LLC, the complete disclosure of which is hereby incorporated herein by reference.

Depending on the design of the patient support apparatuses, certain apparatuses may be provided with mattresses or other patient support features that are not necessarily lined up or flush with one another when the two patient support apparatuses are located and aligned adjacent one another. In this regard, there may be a spatial gap between the mattresses or patient support features. An example of a spatial gap 155 is provided in FIG. 17, discussed in more detail below. In various aspects, when coupling the receiving patient support apparatus 136 with the transferring patient support apparatus 132, the methods may include minimizing or removing any spatial gap between a patient support surface of the receiving patient support apparatus 136 and a patient support surface of the transferring patient support apparatus 132. In this regard, this may include moving a mattress, a patient support structure, or a frame/litter structure of at least one of the receiving patient support apparatus 136 and the transferring patient support apparatus 132 in a lateral direction to minimize or remove the spatial gap 155. In other aspects, an auxiliary bridge transport device 156 (FIG. 17) can be used. Non-limiting examples of a bridge transport device 156 can include substantially planar slide boards or patient transfer boards defining an upper surface having a sufficient size to bridge the spatial gap 155 and be supported by each mattress. Transfer boards having internal roller mechanisms may also be useful.

In still further aspects, it may be desired to continue use of the mattress or patient support feature that is currently used with the transferring patient support apparatus 132. In this regard, the receiving patient support apparatus 136 may be configured as having a base 22 or other supporting frame component, but without a litter 26 or without a mattress 36. The methods of transferring the patient may include transferring a mattress or litter component with a mattress (and carrying the patient) from the transferring patient support apparatus 132 to the receiving patient support apparatus. In various aspects, this may include the use of a rail system component designed to permit the smooth transfer between patient support apparatuses.

EXAMPLES

The following examples provide additional guidance and further illustrate various aspects of the systems and methods of the present technology. The following examples illustrate various configurations of two patient support apparatuses prior to the transfer of the patient, and should be read with reference to the representative figure to which each pertains. It should be understood that these examples are provided for illustrative purposes and are not to be construed as limiting the scope of the present technology.

Figure 12:
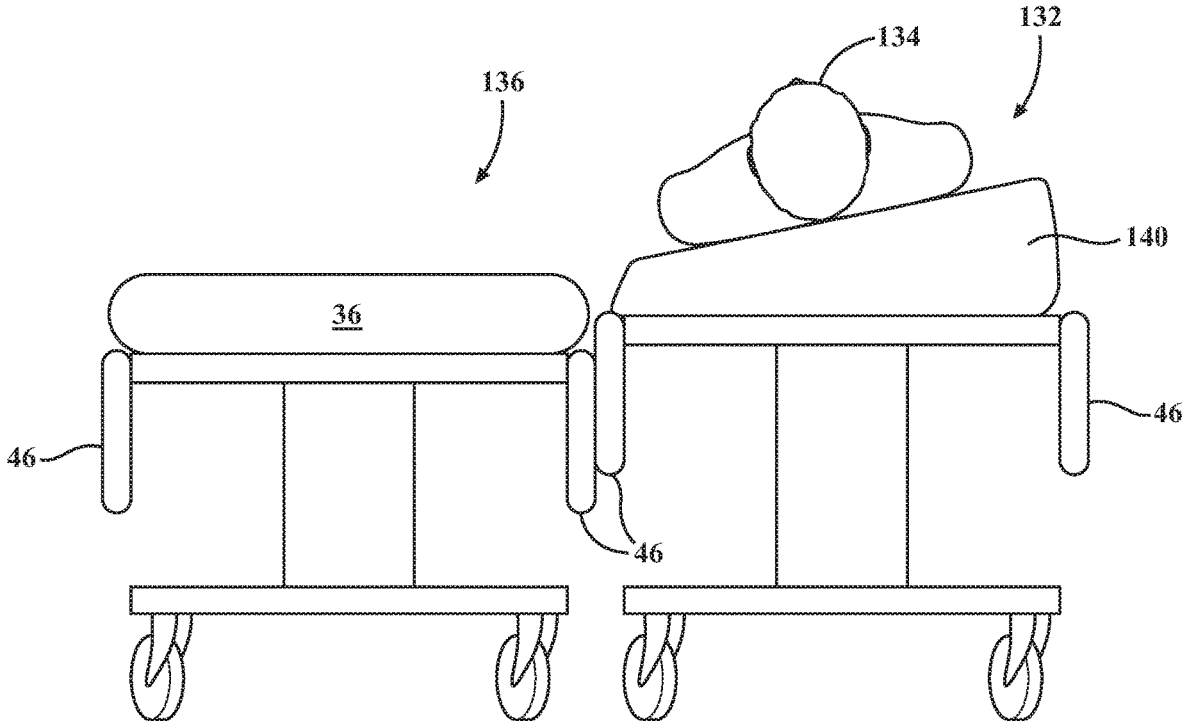
FIG. 12 provides an exemplary schematic diagram of two patient support apparatuses positioned adjacent one another in a first arrangement prior to transferring the patient.

FIG. 12 provides an exemplary schematic diagram of two patient support apparatuses positioned adjacent one another in a first arrangement prior to transferring the patient. As shown in FIG. 12, an inflatable air bladder 140 is provided partially inflated, lifting the right side of the patient. The transferring patient support apparatus 132 is provided with a height of the patient support surface that is slightly higher than the patient support surface of the receiving patient support apparatus 136. The following chart provides a listing of various settings for this example configuration.

| Example Configuration 1 | |
|---|---|
| Set Height | Transferring Apparatus > Receiving Apparatus |
| Set Fowler | Transferring Apparatus = Receiving Apparatus |
| Set Gatch | Transferring Apparatus = Receiving Apparatus |
| Set Side rail | All side rails down |
| Set Auxiliary device (air bladder) | Transferring Apparatus = inflated to incline<br>Receiving Apparatus = none (or flat) |

Figure 13:
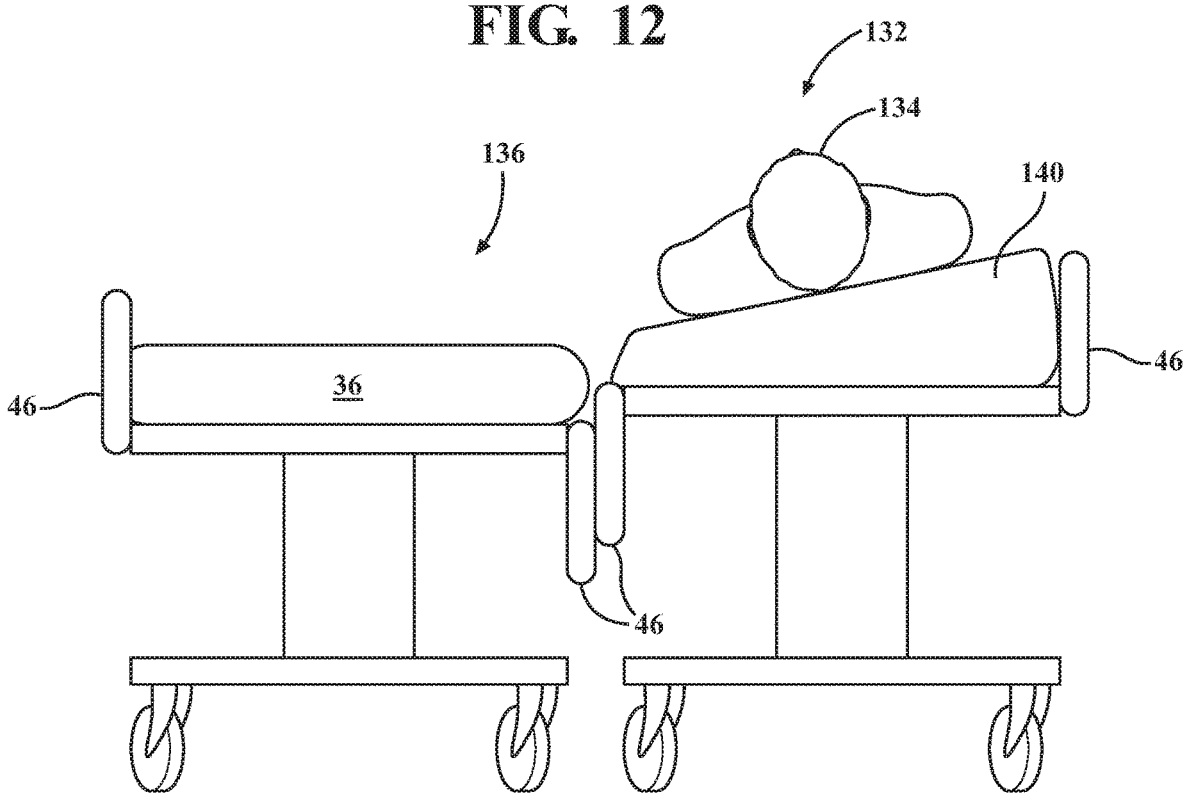
FIG. 13 provides an exemplary schematic diagram of two patient support apparatuses positioned adjacent one another in a second arrangement prior to transferring the patient.

FIG. 13 provides an exemplary schematic diagram of two patient support apparatuses positioned adjacent one another in a second arrangement prior to transferring the patient. The height, fowler, and gatch positions are the same as the first arrangement, however the outer side rails are kept in a raised position, while the inner side rails are provided in a lowered position. The following chart provides a listing of various settings for this example configuration.

| Example Configuration 2 | |
|---|---|
| Set Height | Transferring Apparatus > Receiving Apparatus |
| Set Fowler | Transferring Apparatus = Receiving Apparatus |
| Set Gatch | Transferring Apparatus = Receiving Apparatus |
| Set Side rail | Outer side rails up; inner side rails down |
| Set Auxiliary device (air bladder) | Transferring Apparatus = inflated to incline<br>Receiving Apparatus = none (or flat) |

Figure 14:
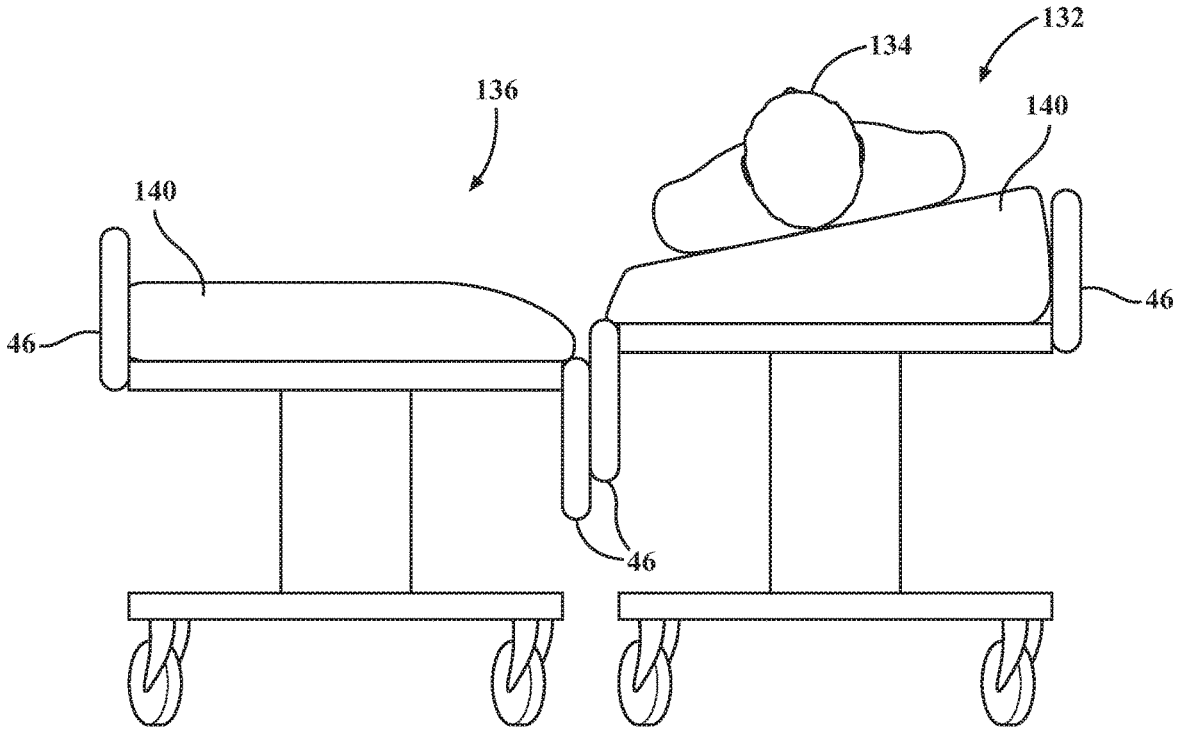
FIG. 14 provides an exemplary schematic diagram of two patient support apparatuses positioned adjacent one another in a third arrangement prior to transferring the patient.

FIG. 14 provides an exemplary schematic diagram of two patient support apparatuses positioned adjacent one another in a third arrangement prior to transferring the patient. The height, fowler, gatch, and side rail positions are the same as the second arrangement, however the air bladder of the receiving patient support apparatus is also inflated to an incline, opposite the incline of the transferring patient support apparatus. The following chart provides a listing of various settings for this example configuration.

| Example Configuration 3 | |
|---|---|
| Set Height | Transferring Apparatus > Receiving Apparatus |
| Set Fowler | Transferring Apparatus = Receiving Apparatus |
| Set Gatch | Transferring Apparatus = Receiving Apparatus |
| Set Side rail | Outer side rails up; inner side rails down |
| Set Auxiliary device (air bladder) | Transferring Apparatus = inflated to incline<br>Receiving Apparatus = inflated to incline |

Figure 15:
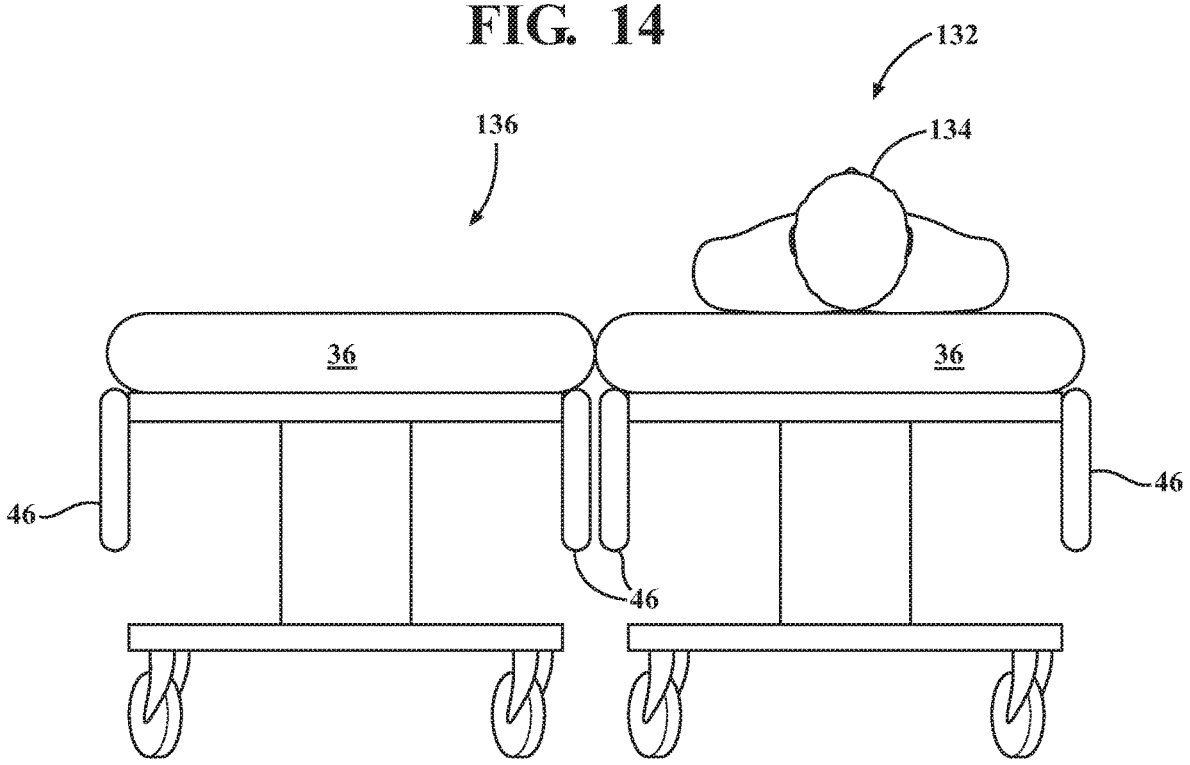
FIG. 15 provides an exemplary schematic diagram of two patient support apparatuses positioned adjacent one another in a fourth arrangement prior to transferring the patient.

FIG. 15 provides an exemplary schematic diagram of two patient support apparatuses positioned adjacent one another in a fourth arrangement prior to transferring the patient. The transferring patient support apparatus 132 is provided with a height of the patient support surface equal to a height the patient support surface of the receiving patient support apparatus 136. The following chart provides a listing of various settings for this example configuration.

| Example Configuration 4 | |
|---|---|
| Set Height | Transferring Apparatus = Receiving Apparatus |
| Set Fowler | Both Apparatuses = Flat/Horizontal |
| Set Gatch | Both Apparatuses = Flat/Horizontal |
| Set Side rail | All side rails down |
| Set Auxiliary device | None |

Figure 16:
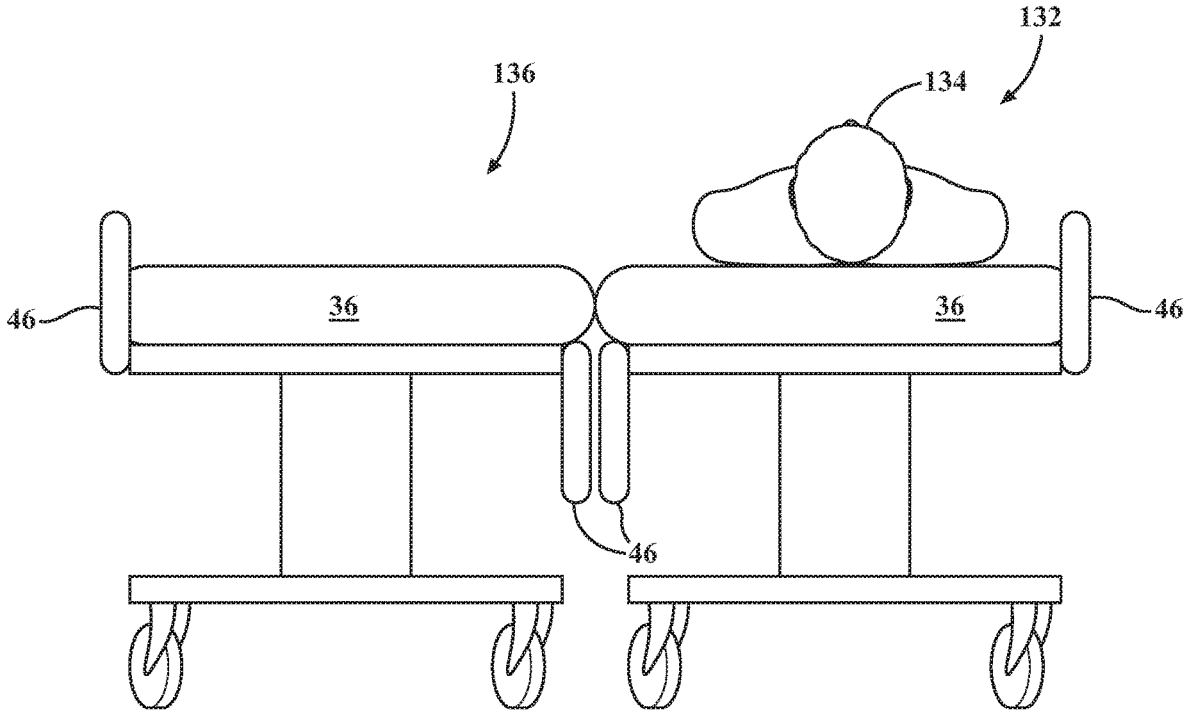
FIG. 16 provides an exemplary schematic diagram of two patient support apparatuses positioned adjacent one another in a fifth arrangement prior to transferring the patient.

FIG. 16 provides an exemplary schematic diagram of two patient support apparatuses positioned adjacent one another in a fifth arrangement prior to transferring the patient. The height, fowler, and gatch positions are the same as the fourth arrangement, however the outer side rails are kept in a raised position, while the inner side rails are provided in a lowered position.

| Example Configuration 5 | |
|---|---|
| Set Height | Transferring Apparatus = Receiving Apparatus |
| Set Fowler | Transferring Apparatus = Receiving Apparatus |

-continued

| Example Configuration 5 | |
|---|---|
| Set Gatch | Transferring Apparatus = Receiving Apparatus |
| Set Side rail | Outer side rails up; inner side rails down |
| Set Auxiliary device | None |

Figure 17:
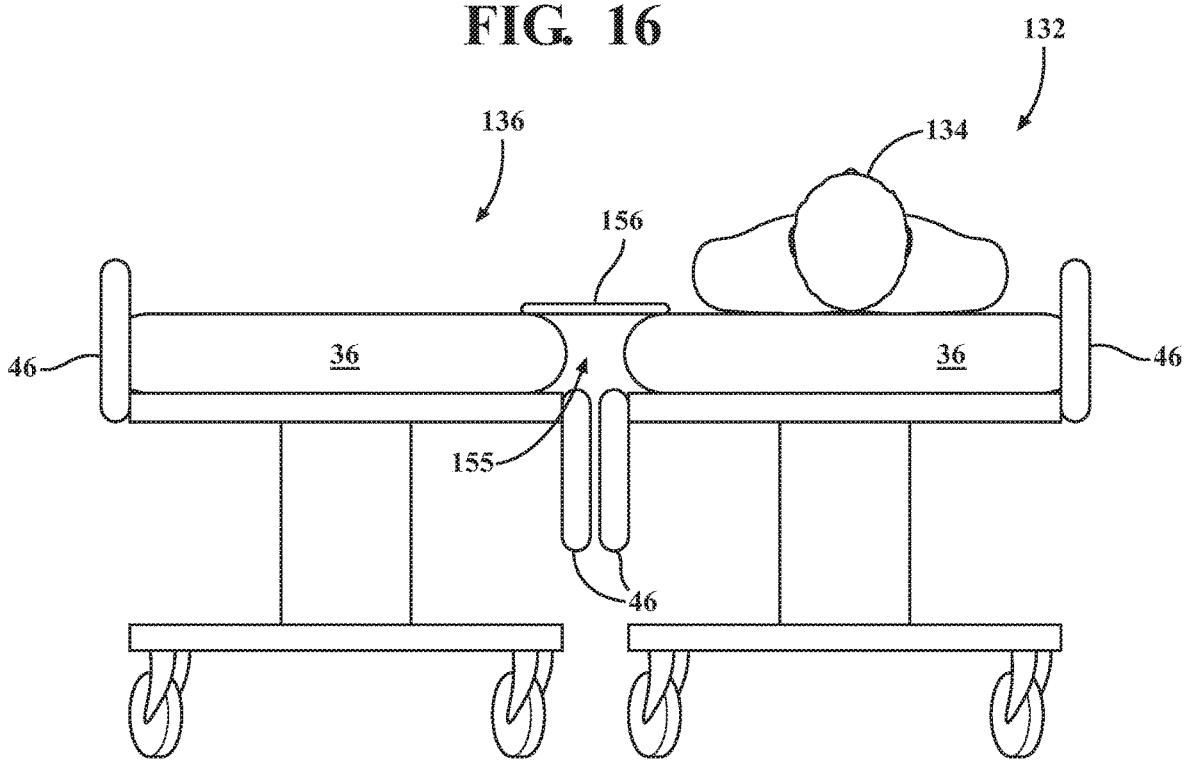
FIG. 17 provides an exemplary schematic diagram of two patient support apparatuses positioned adjacent one another in a sixth arrangement prior to transferring the patient.

FIG. 17 provides an exemplary schematic diagram of two patient support apparatuses positioned adjacent one another in a sixth arrangement prior to transferring the patient. The height, fowler, and gatch positions are the same as the fifth arrangement, however the mattresses are spaced away from one another, leaving a spatial gap 155. A bridge transport device 156 is provided.

| Example Configuration 6 | |
|---|---|
| Set Height | Transferring Apparatus = Receiving Apparatus |
| Set Fowler | Transferring Apparatus = Receiving Apparatus |
| Set Gatch | Transferring Apparatus = Receiving Apparatus |
| Set Side rail | Outer side rails up; inner side rails down |
| Set Auxiliary device | Bridge transport device placed between mattresses |

Figure 18:
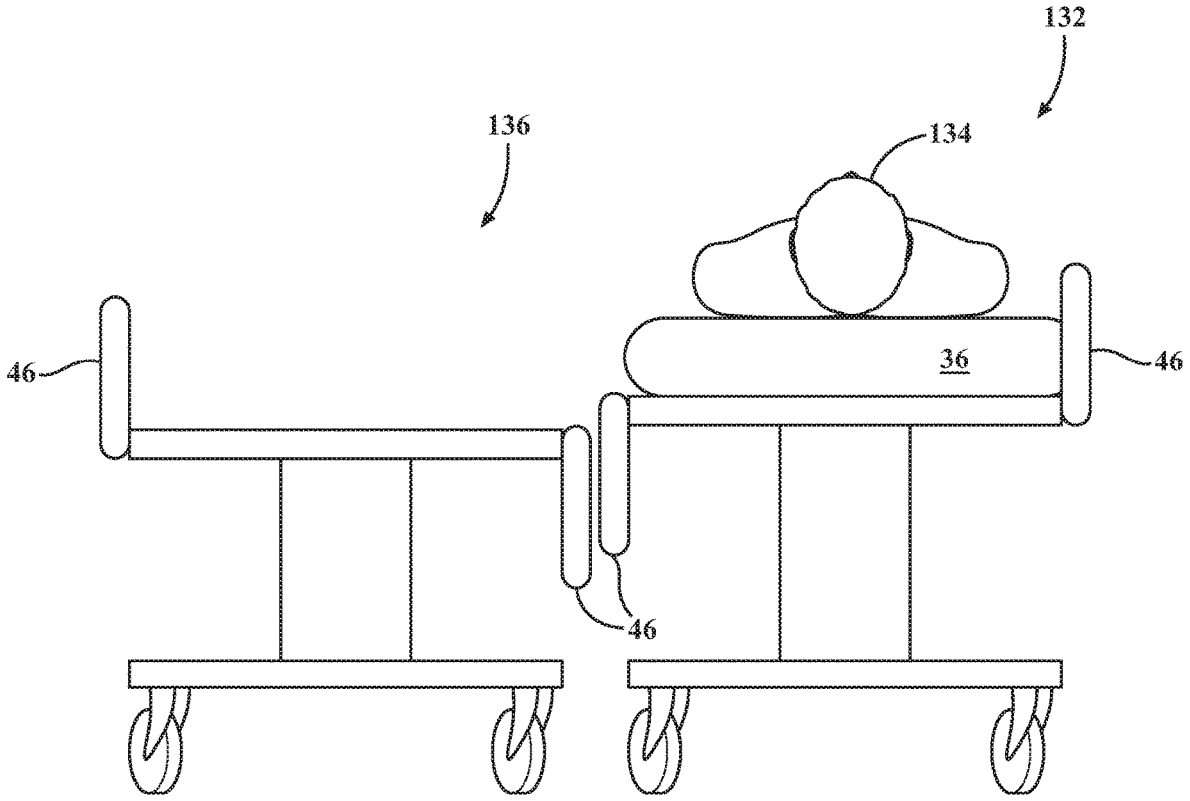
FIG. 18 provides an exemplary schematic diagram of two patient support apparatuses positioned adjacent one another in a seventh arrangement prior to transferring the patient.

FIG. 18 provides an exemplary schematic diagram of two patient support apparatuses positioned adjacent one another in a seventh arrangement prior to transferring the patient. As shown in FIG. 18, the receiving patient support apparatus 136 is not provided with a mattress. The mattress from the transferring patient support apparatus 132 is provided with a height of the patient support surface that is slightly higher than the patient support surface of the receiving patient support apparatus 136. The following chart provides a listing of various settings for this example configuration.

| Example Configuration 7 | |
|---|---|
| Set Height | Transferring Apparatus > Receiving Apparatus |
| Set Fowler | Transferring Apparatus = Receiving Apparatus |
| Set Gatch | Transferring Apparatus = Receiving Apparatus |
| Set Side rail | Outer side rails up; inner side rails down |
| Set Auxiliary device | None |

The foregoing description is provided for purposes of illustration and description and is in no way intended to limit the disclosure, its application, or uses. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range, including the endpoints.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should be also understood that the various method steps discussed herein do not have to be carried out in the same order as depicted, and not each method step is required in each aspect or embodiment.

What is claimed is:

1. An automated system for coordinating a transfer of a patient between patient support apparatuses, the system comprising: a first patient support apparatus having a patient support surface supported by an adjustable frame; a second patient support apparatus having a patient support surface supported by an adjustable frame; and at least one of the first and second patient support apparatuses comprising a controller configured to wirelessly communicate with at least one of the first and second patient support apparatuses, wherein the controller comprises programmable instructions sufficient to coordinate automated movements of one or both of the first and second patient support apparatuses in order to: physically couple the first and second patient support apparatuses to one another at a preferential transfer position; engage or monitor at least one safety feature; and provide an indication that it is safe to transfer the patient between the first and second patient support apparatuses.

2. The system according to claim 1, wherein each patient support apparatus comprises a controller.

3. The system according to claim 2, wherein communication between the controllers of the respective first and second patient support apparatuses is established using at least one wireless communication protocol selected from the group consisting of: Bluetooth, near-field communication (NFC), infrared communication, radio wave communication, cellular network communication, and wireless local area network communication (Wi-Fi).

4. The system according to claim 1, wherein the controller is configured to assign each patient support apparatus with a status as one of a transferring apparatus and a receiving apparatus.

5. The system according to claim 4, wherein the controller is configured to determine a weight supported on at least one of the first and second patient support apparatuses and assigns the status based on the weight.

6. The system according to claim 4, wherein the controller is configured to coordinate a height adjustment of one or both of the first and second patient support apparatuses to an optimal transfer height.

7. The system according to claim 4, wherein the safety feature is selected from the group consisting of: applying or locking a brake, erecting or locking a side rail, receiving an indication that the receiving apparatus and the transferring apparatus remain properly coupled, and receiving an indication that any spatial gap between the receiving apparatus and the transferring apparatus is minimized or removed.

8. The system according to claim 1, wherein at least one of the first and second patient support apparatuses comprises an automatic drive mechanism configured to provide for autonomous movement to locate, align, and physically move the first and second patient support apparatuses adjacent one another.

9. The system according to claim 1, wherein at least one of the first and second patient support apparatuses comprises a beacon configured to transmit current setting or configuration information to the controller.

10. An automated system for coordinating a transfer of a patient between patient support apparatuses, the system comprising:

first and second patient support apparatuses, each patient support apparatus comprising:

an adjustable frame;

a patient support surface supported by the adjustable frame;

an automated drive mechanism;

a communication module; and a controller configured to coordinate an automated movement of the adjustable frame, the controller comprising programmable instructions sufficient to:

establish a wireless communication between the first and second patient support apparatuses;

adjust a position of at least one of the first and second patient support apparatuses;

locate and align the first and second patient support apparatus adjacent one another;

physically couple the first patient support apparatus with the second patient support apparatus;

provide an indication that it is safe to transfer the patient between the first and second patient support apparatuses; and uncouple the first and second patient support apparatuses.

11. The system according to claim 10, wherein the controller comprises programmable instructions to assign the patient support apparatus with a status as one of a receiving apparatus and a transferring apparatus.

12. The system according to claim 11, wherein the controller comprises programmable instructions to assign the status based on a weight of the respective patient support apparatus.

13. The system according to claim 10, further comprising an auxiliary transfer aid device configured to assist with a movement of the patient, wherein the controller comprises programmable instructions to coordinate an engagement of the auxiliary transfer aid device.

14. The system according to claim 13, wherein the auxiliary transfer aid device comprises at least one of an adjustable air bladder, a bridge transport device, and a sheet transfer device.

15. The system according to claim 10, wherein the controller comprises programmable instructions to engage, lock, and disengage a brake.

16. The system according to claim 10, wherein the controller comprises programmable instructions to adjust an angular orientation of at least one portion of the patient support surface.

17. The system according to claim 10, wherein the controller comprises programmable instructions to couple the patient support apparatuses using at least one of a mechanical or magnetic coupling mechanism.

18. The system according to claim 10, wherein the controller comprises programmable instructions to engage the automated drive mechanism to autonomously locate, align, and physically move the first and second patient support apparatuses adjacent one another.

19. The system according to claim 10, wherein the communication module establishes a wireless communication between the respective first and second patient support apparatuses using at least one protocol selected from the group consisting of: Bluetooth, near-field communication (NFC), infrared communication, radio wave communication, cellular network communication, and wireless local area network communication (Wi-Fi).

20. The system according to claim 10, wherein the controller comprises programmable instructions to adjust a height position based on an optimal transfer height obtained using patient-specific information.

* * * * *